US007080917B2

(12) United States Patent
Su

(10) Patent No.: US 7,080,917 B2
(45) Date of Patent: Jul. 25, 2006

(54) UMBRELLA HANDLE STRUCTURE WITH LIGHTING FUNCTION

(75) Inventor: Ping-Tung Su, P.O. Box No. 6-57, Junghe, Taipei 235 (TW)

(73) Assignees: Ping-Tung Su, Hsin-Chu (TW); Jeffrey Steven Blauer, Portland, OR (US)

( * ) Notice: Subject to any disclaimer, the term of this patent is extended or adjusted under 35 U.S.C. 154(b) by 0 days.

(21) Appl. No.: 11/020,336

(22) Filed: Dec. 27, 2004

(65) Prior Publication Data

US 2006/0139910 A1 Jun. 29, 2006

(51) Int. Cl.
*A45B 3/02* (2006.01)

(52) U.S. Cl. ..... 362/102; 362/802; 135/910

(58) Field of Classification Search ..... 362/102, 362/800, 802; 135/910
See application file for complete search history.

(56) References Cited

U.S. PATENT DOCUMENTS 4,881,154 A * 11/1989 Tseng et al. ..... 362/102

6,752,509 B1 * 6/2004 Lin et al. ..... 362/102

* cited by examiner

*Primary Examiner*—Stephen F Husar
(74) *Attorney, Agent, or Firm*—Birch, Stewart, Kolasch & Birch, LLP

(57) ABSTRACT

An umbrella can include a handle forming a cavity within the handle, and a holder disposed within the cavity. The holder can have a first position within the cavity and a second position disposed telescopically from the handle. The umbrella may further include a replaceable power supply, a light source, and a set of cutoff switches disposed within the holder. The cutoff switches can be electrically connected to the replaceable power supply and embedded in the holder. What is more, the holder can be pulled telescopically out of the cavity to the second position to connect the light source to the power supply through the release of the cutoff switches and to automatically activate the light source. In addition, the holder can be pushed back into the cavity to the first position, thereby restoring the handle to its original state.

5 Claims, 5 Drawing Sheets

UMBRELLA HANDLE STRUCTURE WITH LIGHTING FUNCTION

BACKGROUND OF THE INVENTION

1. Field of the Invention

The present invention relates to an umbrella handle structure with lighting function, and more particularly to an umbrella structure having flexible usability that provides illumination when a lighting function is required, and allows restoring to original state when lighting function is not required.

2. Description of the Prior Art

Importance attached to quality of life today means lighting implementations are no longer limited to having single function, single usage. Hence, present related technology industries are constantly contemplating how best to achieve effective enhancement in a safe lifestyle under a lifestyle that demands a halt on number of portable items carried.

With reference to conventional umbrella structures, majority of which are configured with an umbrella canopy and umbrella ribs that function to support the umbrella canopy, and whereby such a configuration serves as a shield from the sun or rain. Furthermore, an umbrella handle is also connected to one end of a shaft to provide users with a place to hold the umbrella.

However, on a rainy day or during night-time, there is generally a certain degree of obstruction to line of vision. If a lighting implementation is available for simultaneous use with shielding from the rain or when walking at nighttime, in one aspect, and to illuminate road surface for more convenient walking which also provides a warning light to passing vehicles, thereby reinforcing safety of people when walking on a rainy day or at nighttime. Prior art, wherein inventors have disclosed umbrella structures configured with a lighting implementation (for instance, Taiwan patent No. 91762, Taiwan patent No. 18472 and Taiwan patent No. 140741), which have the following shortcomings:

1. The aforementioned conventional illuminated umbrella structures generally have the illumination implementation directly installed within the umbrella handle or directly attached to one end of the umbrella handle. However, such configurations not only abnormally increase the overall size or length of the umbrella handle, moreover, they imperceptibly increase inconvenience to a user.

2. The aforementioned conventional illuminated umbrella structures generally have a light source affixed to an umbrella handle or embedded within the umbrella handle, and material of the umbrella handle is altered to enable lighting to spread out from the light source. However, such configurations result in a poor spreading-out illuminating effect from the light source, and, moreover, produce a brusque effect that contributes to negative eye-appeal to the umbrella handle.

SUMMARY OF THE INVENTION

In light of the aforementioned shortcomings, a primary objective of the present invention is to provide an umbrella handle structure with lighting function having flexible usability that provides illumination when a lighting function is required, and allows restoring to original state when the lighting function is not required.

Another objective of the present invention is to provide the umbrella handle structure with lighting function, which not only enhances functionality of the umbrella handle, moreover, is more appealing to the eye, safer and more practicable.

In order to achieve the aforementioned objectives, the present invention provides the umbrella handle structure with lighting function comprising:

an umbrella handle, which is connected to an umbrella, having a containment cavity defined on the umbrella handle;

a lighting holder disposed within the containment cavity of the umbrella handle, and the lighting holder can be freely pulled out of or pushed back into the containment cavity.

a replaceable power supply device disposed within the lighting holder;

a set of a light source and cutoff switches electrically connected to the power supply device and embedded to the lighting holder;

wherein, the power supply device supplies needed power through the cutoff switches. When use of lighting function is required of the present invention, a user needs only to pull the lighting holder out from the containment cavity, which releases the cutoff switches from the originally pressed down state against a wall surface of the containment cavity and connects power from the power supply device. Power is then supplied to the light source electrically connected to the power supply device, and thus automatically illuminates. When the lighting function is no longer required, the user needs only to push the lighting holder back into the containment cavity, which thereby restores the umbrella handle to original form.

In addition, angle of illumination of the light source can be freely adjusted vertically, thereby enabling the light source to project light upwards or downwards to illuminate required areas.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

A particular embodiment is used here to describe a practical example of the present invention. Persons familiar with related art will easily understand other advantages and functionality of the present invention from the contents disclosed herein.

Figure 1:
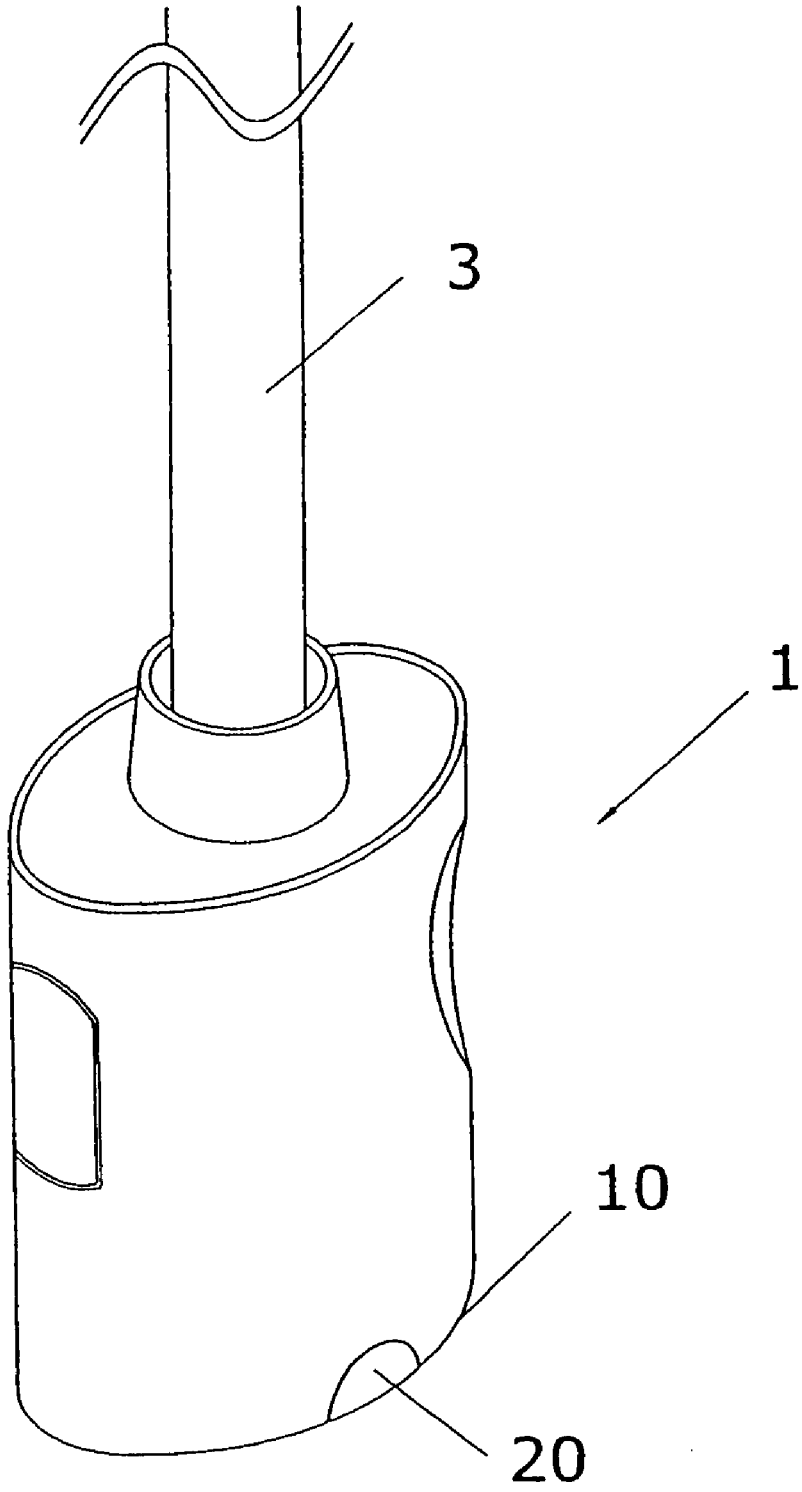
FIG. 1 shows a schematic elevational view of an umbrella handle structure with lighting function prior to releasing a lighting holder according to the present invention.
Figure 2:
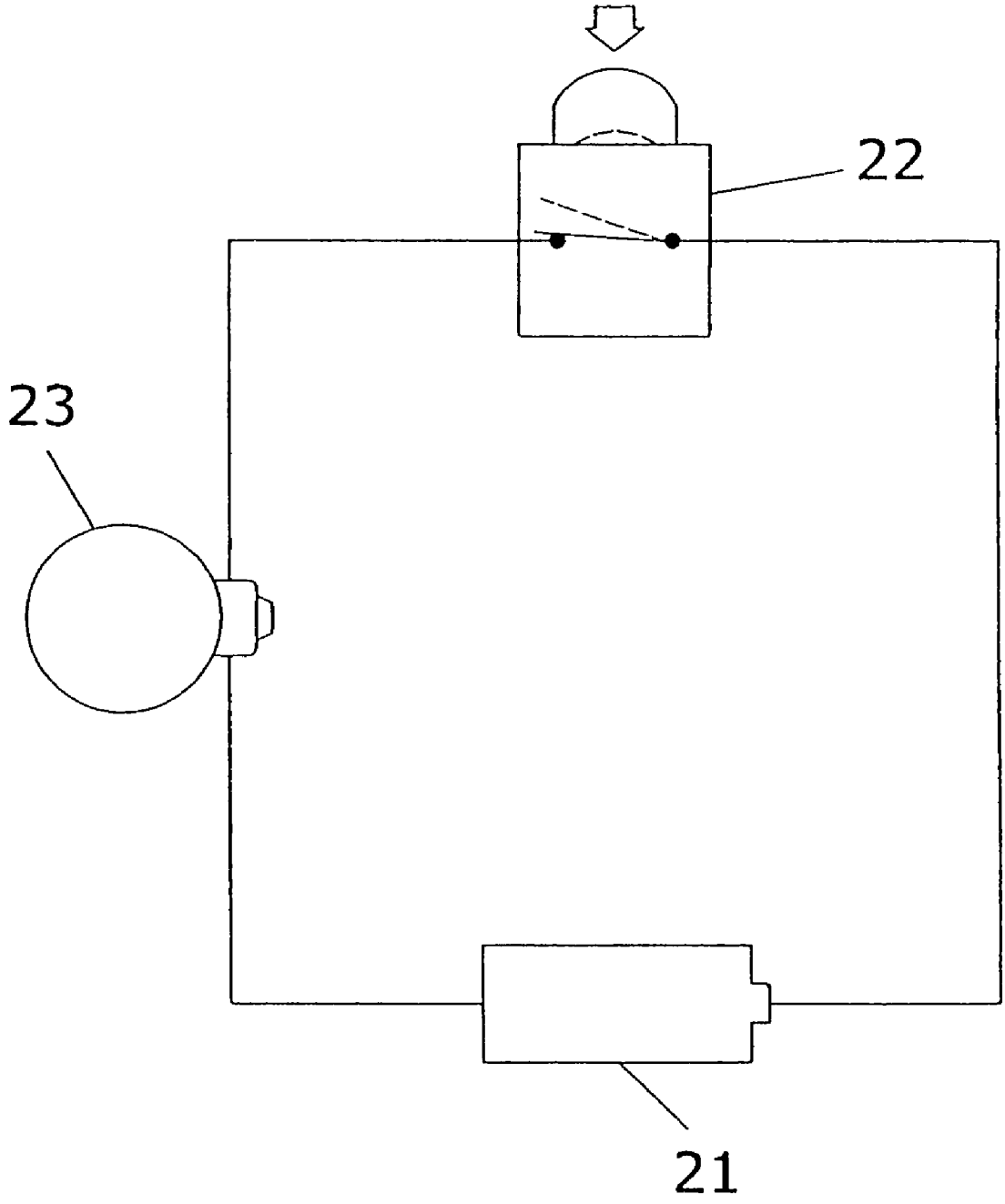
FIG. 2 shows a schematic circuit diagram within the lighting holder of the umbrella handle structure with lighting function according to the present invention.
Figure 3:
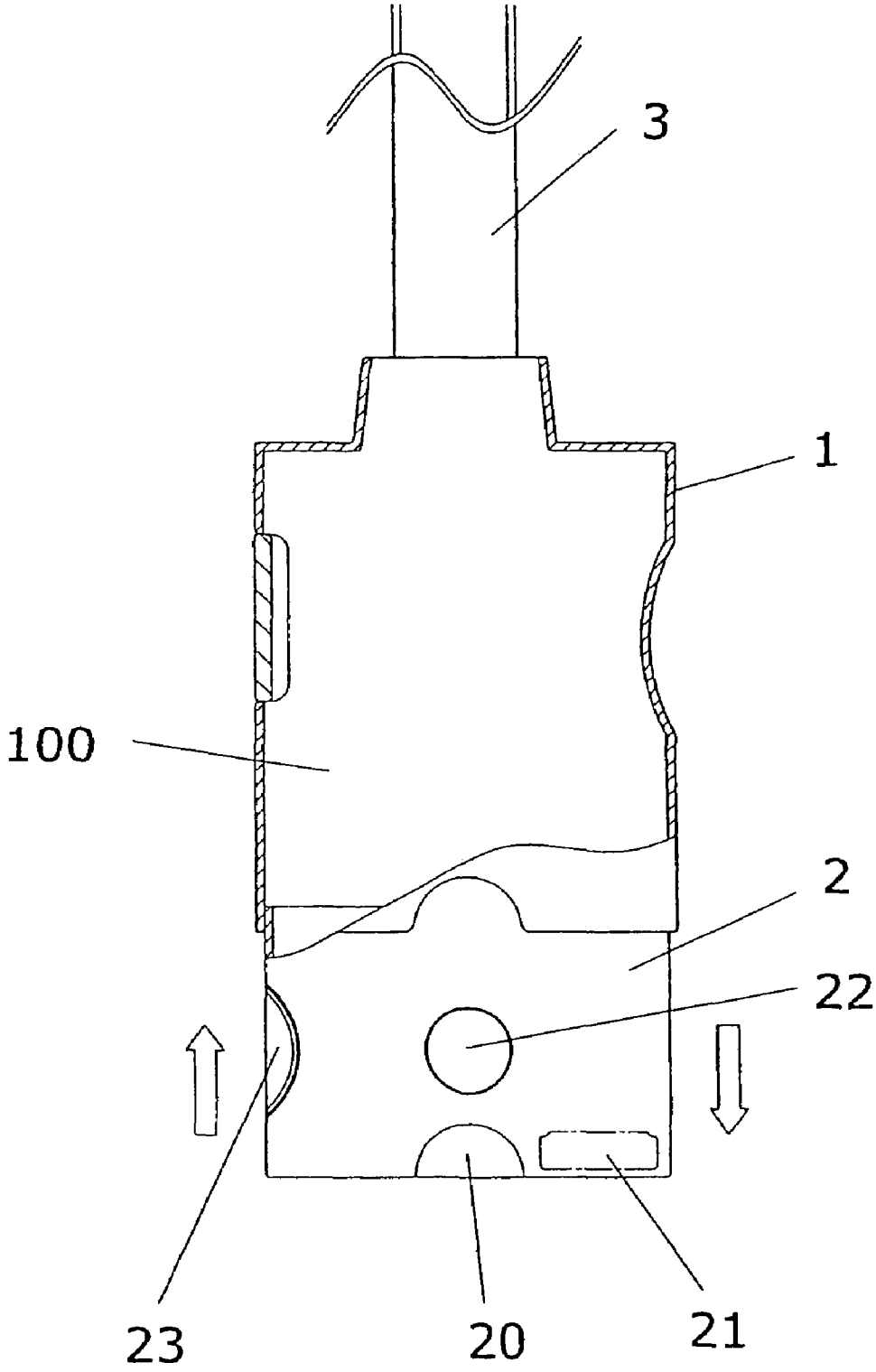
FIG. 3 shows a partial schematic sectional side view of the umbrella handle structure with lighting function according to the present invention.

Referring to FIGS. 1, 2 and 3, as one descriptive example of the present invention, a light source of an embodiment is a lighting using a light-emitting diode (LED) module, however, art as used in the present invention is not limited to application of the lighting using an LED light module.

As depicted in the aforementioned FIGS. 1, 2, and 3, an umbrella handle structure with lighting function of the present invention comprises at least an umbrella handle 1, which is configured so as to connect to one end of a shaft 3. Another end of the shaft 3 connects to an umbrella canopy and umbrella ribs (not shown in the FIGS). The umbrella handle 1 provides for a place for a user to hold the umbrella. Furthermore, a containment cavity 100 is defined at one end of the umbrella handle 1, and a lighting holder 2 is inset within the containment cavity 100 of the umbrella handle 1. Moreover, withdraw members 20 are respectively configured on two sides of the lighting holder 2. The lighting holder 2 can be pulled out telescopically from within the umbrella handle 1 (a first position) by pressing the two withdraw members 20 and pulling downward on the lighting holder 2 (a second position). When such a lighting implementation is not in use, the lighting implement can be conveniently pushed back into the containment cavity 100. A replaceable power supply device 21 is contained within the lighting holder 2. A lighting using an LED light module 23 and cutoff switches 22 are electrically connected to the power supply device 21. The lighting using an LED light module 23 is inset in a front portion of the lighting holder 2, and, moreover, angle of illumination of the lighting using an LED light module 23 can be freely adjusted vertically, thereby enabling the lighting using an LED light module 23 to project light upwards or downwards. The cutoff switches 22 are respectively moveably configured on two sides of the lighting holder 2 such that power supply is cut off when the cutoff switches 22 are pressed, and the power supply is switched on when the lighting holder 2 is being released.

Figure 4:
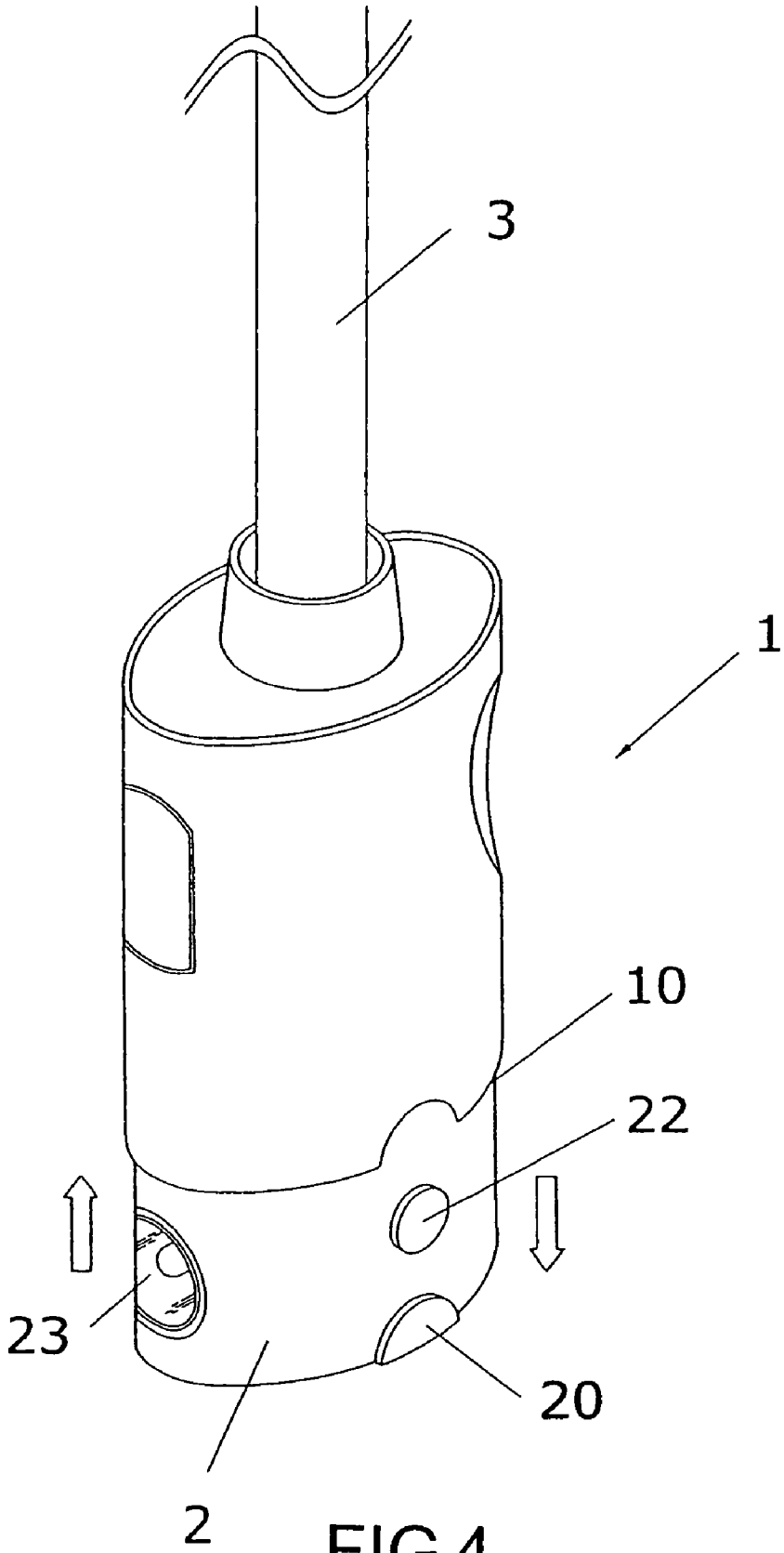
FIG. 4 shows a schematic motion view of the umbrella handle structure with lighting function after releasing the lighting holder according to the present invention.

Furthermore, referring to FIG. 4 in conjunction with the aforementioned FIGS. 1, 2 and 3, at nighttime or when raining, where line of vision is poor, a user can press on the withdraw members 20, whereupon the lighting holder 2 can be pulled out from the containment cavity 100. After the lighting holder 2 is pulled out from the containment cavity 100, the cutoff switches 22 are released from the originally pressed down state against a wall surface of the containment cavity 22. The released cutover cutoff switches 22 connects power to the power supply device 21, and power is then supplied to the lighting using an LED light module 23 electrically connected to the power supply device 21, and the lighting using an LED light module 23 automatically illuminates.

Figure 5:
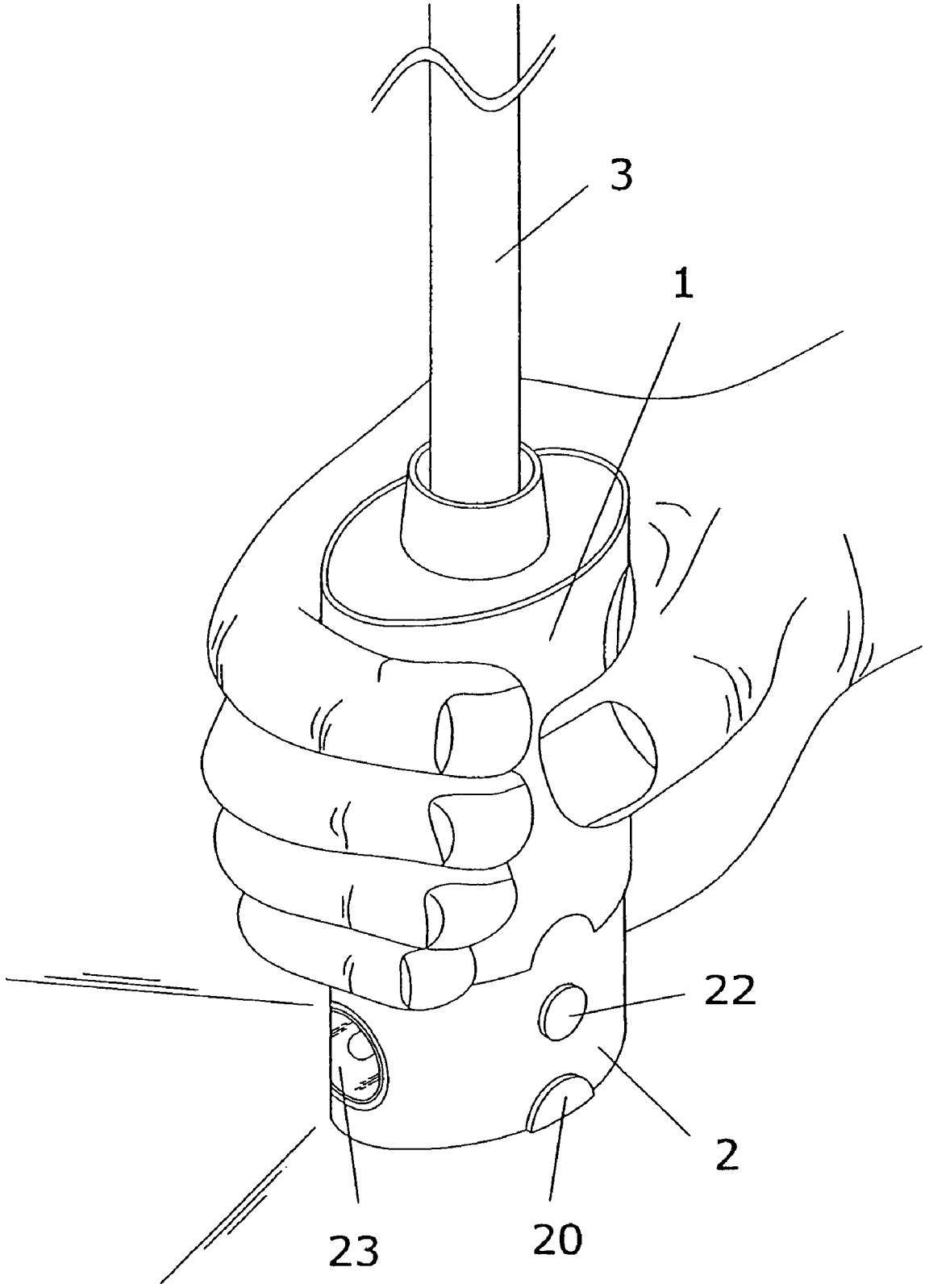
FIG. 5 shows a schematic view of the umbrella handle structure with lighting function in practical usage according to the present invention.

Furthermore, referring to FIG. 5 in conjunction with the aforementioned FIGS. 1, 2, 3 and 4, a user needs only to pull downward on the withdraw members 20 to extract the lighting holder 2 from the containment cavity 100. The user then grips the umbrella handle 1 with his hand, and naturally holds up the umbrella, whereupon the lighting using an LED light module 23 automatically emits light.

When the user no longer desires to use the lighting implementation, the user needs only to push the lighting holder 2 back into the containment cavity 100, which thereby restores the umbrella handle 1 to original form, and also stores away the lighting implement, thus achieving objectives of lighting, storage, eye-appeal and practicability.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An umbrella, comprising:

a handle and a cavity formed within said handle;

a holder disposed within said cavity, wherein said holder has a first position within said cavity and a second position disposed telescopically from said handle;

a replaceable power supply, a light source, and a set of cutoff switches disposed within said holder wherein said cutoff switches are electrically connected to said replaceable power supply and embedded in said holder;

whereby said holder can be pulled telescopically out of said cavity to said second position to connect said light source to said power supply through the release of said cutoff switches and automatically activating said light source, and said holder can be pushed back into said cavity to said first position, thereby restoring said handle to its original state.

2. An umbrella according to claim 1, wherein said holder further comprises at least one withdraw member on each side of said holder.

3. An umbrella according to claim 1, wherein an angle of illumination of said light source is vertically adjustable in both an upward and a downward direction.

4. An umbrella according to claim 1, wherein said light source is a light-emitting diode (LED).

5. An umbrella according to claim 1, wherein said light source in said first position is covered by said handle.

* * * * *